US005402733A

United States Patent [19]

Humphreys

[11] Patent Number: 5,402,733

[45] Date of Patent: Apr. 4, 1995

[54] STOCKING POSITIONING DEVICE

[76] Inventor: John C. Humphreys, 3, Cowper Road, Burbage, Hinckley, Leicester, England

[21] Appl. No.: 907,834

[22] PCT Filed: Jan. 4, 1991

[86] PCT No.: PCT/GB91/00007

§ 371 Date: Jul. 2, 1992

§ 102(e) Date: Jul. 2, 1992

[87] PCT Pub. No.: WO91/10769

PCT Pub. Date: Jul. 25, 1991

[30] Foreign Application Priority Data

Jan. 9, 1990 [GB] United Kingdom ..... 9000463

[51] Int. Cl.[6] ..... D05B 21/00

[52] U.S. Cl. ..... 112/121.15; 112/304

[58] Field of Search ..... 112/27, 121.12, 121.15, 112/304, 262.2, 63; 66/178 R, 202; 28/168

[56] References Cited

U.S. PATENT DOCUMENTS

| | | | |
|---|---|---|---|
| 4,192,242 | 3/1980 | Haselgrove et al. . | |
| 4,541,351 | 9/1985 | Horita et al. | 112/262.2 |
| 4,620,650 | 11/1986 | Gazzarrini . | |
| 4,957,051 | 9/1990 | Maegawa et al. | 112/121.12 |
| 5,058,516 | 10/1991 | Maegawa et al. | 112/121.15 X |

FOREIGN PATENT DOCUMENTS

| | | |
|---|---|---|
| 166594 | 1/1986 | European Pat. Off. . |
| 7120700 | 9/1971 | Germany . |
| 982442 | 2/1965 | United Kingdom . |
| 2066862 | 7/1981 | United Kingdom . |
| 2140467 | 6/1986 | United Kingdom . |
| 2217354 | 10/1989 | United Kingdom . |

*Primary Examiner*—Clifford D. Crowder
*Assistant Examiner*—Paul C. Lewis
*Attorney, Agent, or Firm*—Frijouf, Rust & Pyle

[57] ABSTRACT

A stocking positioning device (10) for use with a panti-hose manufacturing machine having a number of arm assemblies (12), each of which consists of upper and lower pairs of support arms (16, 18) for supporting respective first and second stockings (14) to be cut and seamed together to form a pair of panti-hose, the positioning device comprising upper and lower pairs of endless belts (20, 22, 24, 26), each belt being driven by its own pair of pulleys (28–42), the belts of each pair being horizontally spaced apart with the left hand belts (20, 24) rotating in the opposite direction to the right hand belts (22, 26), the pulleys being movable in unison vertically to move the belts, in use, between an upper rest position, above the arms (16, 18) of an arm assembly (12) moving from a loading station (A), to a lower operative position, in which the belts of each pair lie alongside the arms. Each pulley (28–42) is also independently movable laterally of the belt towards and away from the arm assembly. With the stockings (14) loaded on the arms (16, 18), the belts can, by lateral movement, be brought into contact with them and the linear movement of each belt thus moves the stockings along their arms until sensors (54, 56) register the required positioning of each of the stockings for accurate cutting and seaming together, whereupon the belts are moved laterally from engagement with the stockings and then raised to their rest position and returned to the loading station for use with the next arm assembly.

11 Claims, 7 Drawing Sheets

STOCKING POSITIONING DEVICE

The present invention relates to a stocking positioning device, primarily for use in the manufacture of panti-hose.

A large proportion of panti-hose is manufactured automatically. One machine which is used in the manufacture of panti-hose is a line closing machine such as the Takatori line closer which is described and illustrated in British Patent Number 1 575 189. A line closing machine has a number of arm assemblies each of which consists of upper and lower pairs of support arms. The upper pair of arms supports a first stocking whilst the lower pair of arms supports a second stocking and during operation the two stockings are cut and seamed together to form a pair of panti-hose.

One of the problems encountered with a machine of this type is loading each stocking onto the respective pair of support arms to ensure that each stocking is accurately positioned to ensure proper seaming together of the two stockings to form a pair of panti-hose.

An object of the invention is to provide an improved stocking positioning device which facilitates such accurate loading of two stockings for subsequent seaming.

Accordingly, the present invention provides a device for positioning a pair of stockings on a machine of the type having a number of arm assemblies each of which consists of upper and lower pairs of support arms, the upper pair supporting, in use, a first stocking and the lower pair supporting, in use, a second stocking, the two stockings being cut and seamed together, during operation of the machine, to form a pair of panti-hose, characterised in that the device comprises:

respective first means for engaging opposite sides of each stocking loaded onto an arm assembly of said machine, said first means being movable between a first, retracted position away from said stockings, and a second, operative position adjacent said stockings;

and means for moving said first means into engagement with said stockings to effect adjustment of the position of said stockings on said arm assembly;

and wherein the first means comprise an upper pair and a lower pair of belts each being capable of linear movement when contacting a stocking to effect said adjustment.

The present invention will now be described, by way of example, with reference to the accompanying drawings, in which.

Figure 5:
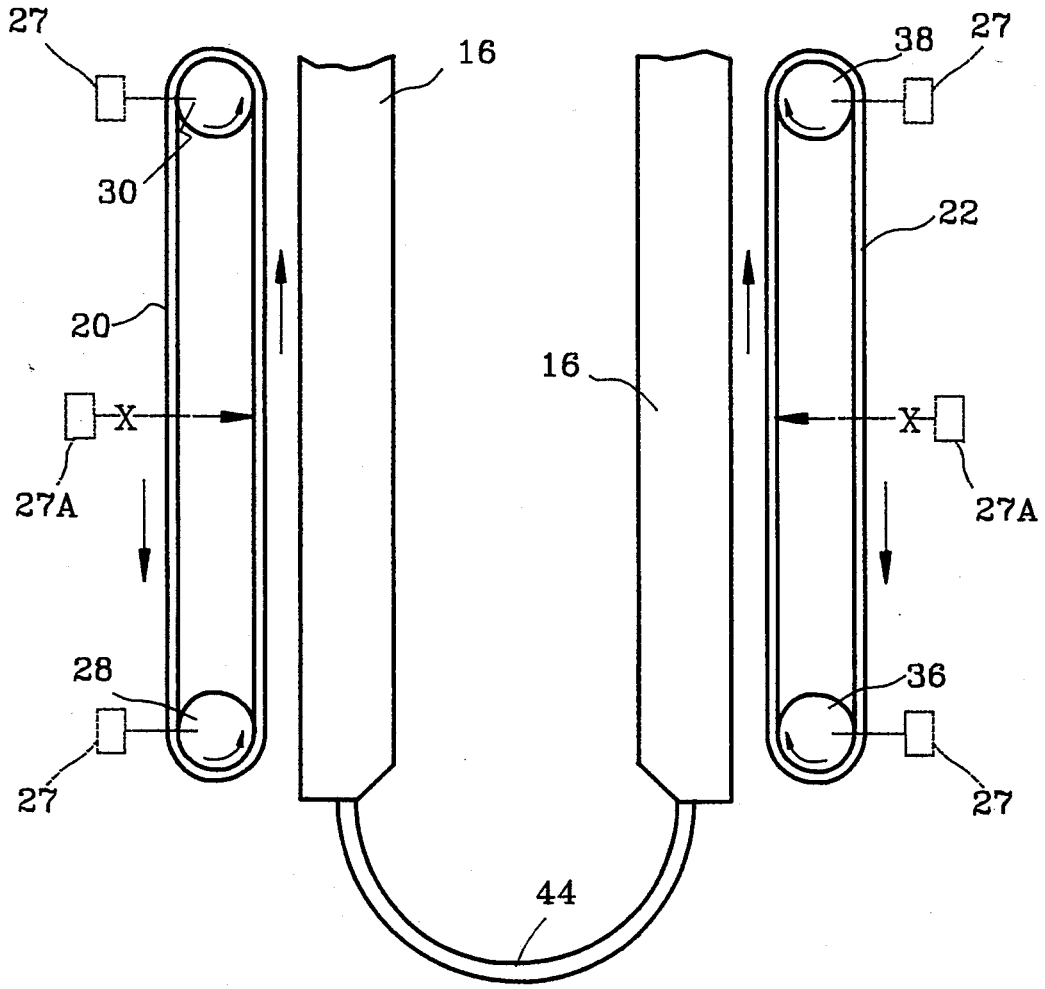
FIG. 5 is a plan view of the arrangement of FIG. 4.

FIG. 10*a* to 10*l* respectively show diagrammatically various views similar to that of FIG. 5, illustrating possible forms of engagement of the positioning device with the arm assembly for positioning of the stockings.

Figure 1:
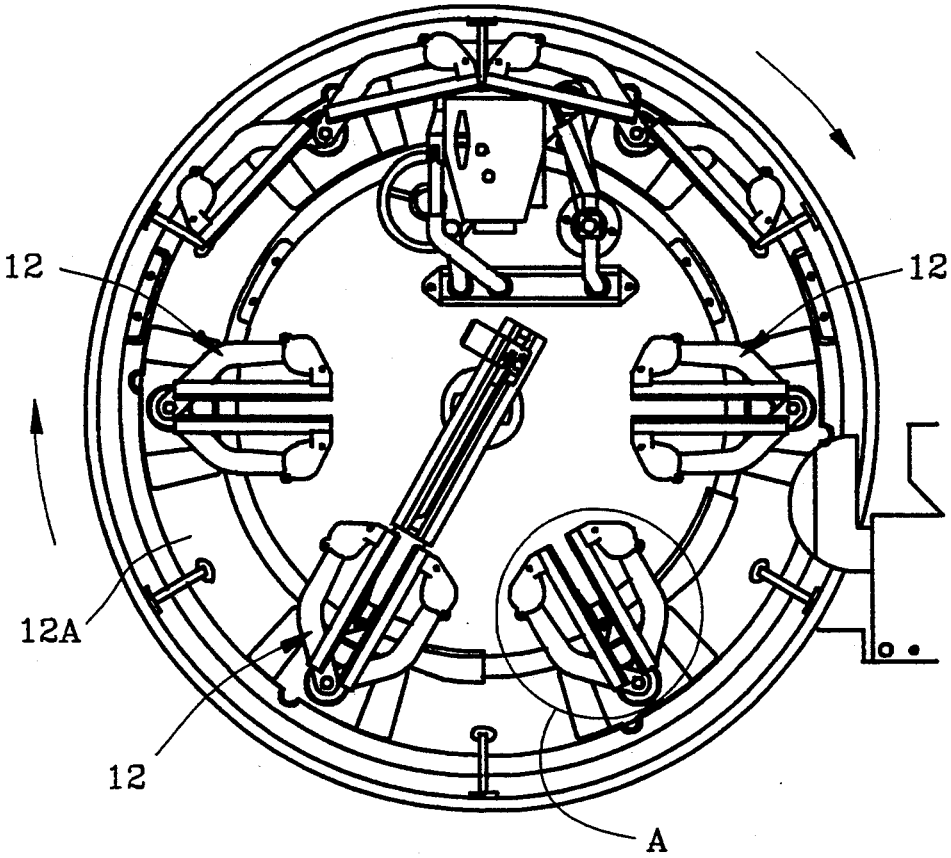
FIG. 1 is a plan view of a known line closing machine.
Figure 2:
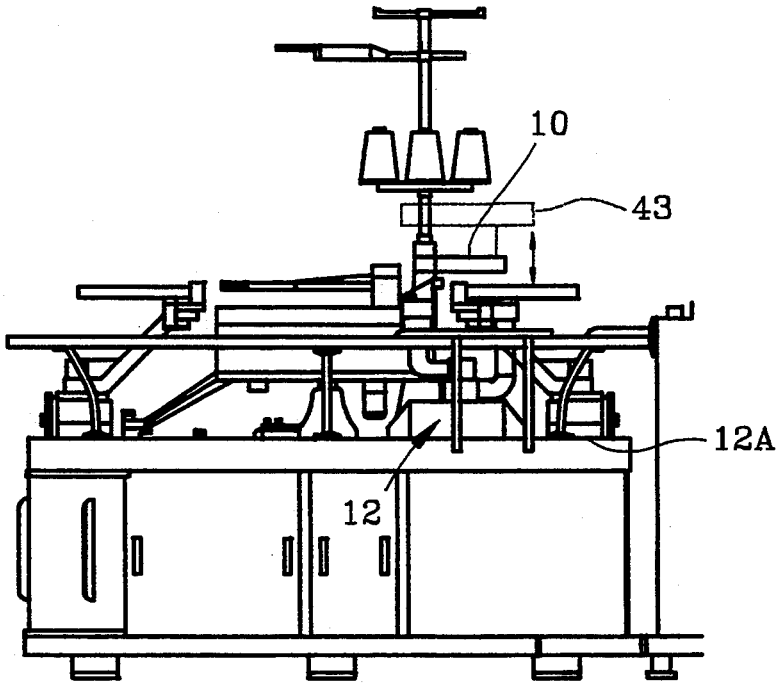
FIG. 2 is a side view of the machine of FIG. 1, showing the rest position of a schematically illustrated positioning device of the invention.
Figure 3:
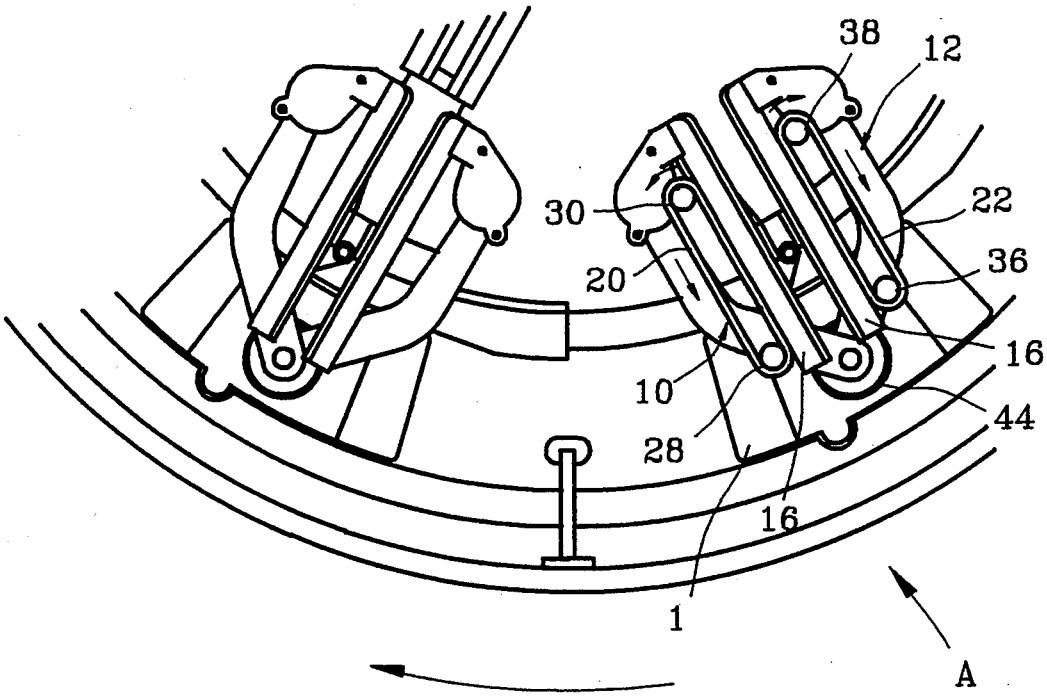
FIG. 3 is an enlarged plan view showing an arm assembly of the machine of FIGS. 1 and 2 together with the positioning device of FIG. 2, in more detail.

Referring to the drawings, FIG. 1 illustrates a line closing machine, such as the Takatori line closer, which has a plurality, being six in the arrangement illustrated, of arm assemblies 12 mounted on a turntable 12A, rotary indexing of which brings the assemblies 12 successively into a working position at a loading station A, in conventional manner. As can be seen from FIGS. 2 and 3, a positioning device 10 of the invention is located immediately above the arm assembly 12 at the loading station A and can be moved selectively between an upper rest position and a lower operative or working position. As will be described, a respective stocking 14 is loaded manually or automatically onto each of the upper and lower pair of arms 16, 18 of the arm assembly 12 (FIGS. 4 to 6 and 8 and 9), following which the positioning device 10 is lowered into its operative position. The line closer may or may not be angularly moving during loading, since its operation may be continuous or intermittent. However use of the positioning device envisages continuous operation.

Figure 6:
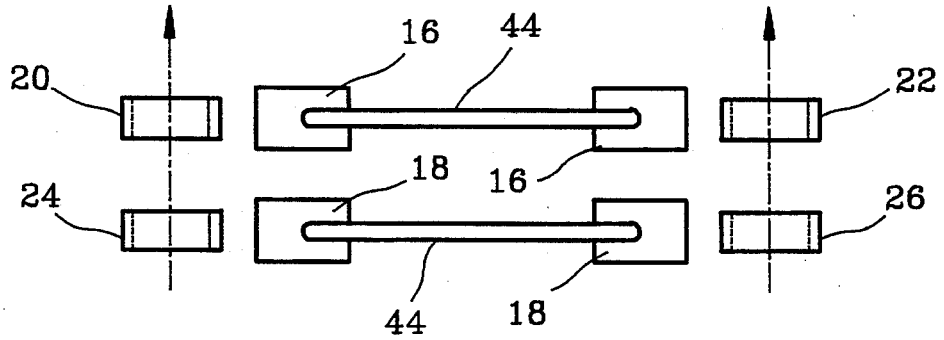
FIG. 6 is a view similar to that of FIG. 4, but with the positioning device in its lowered, operative position.
Figure 7:
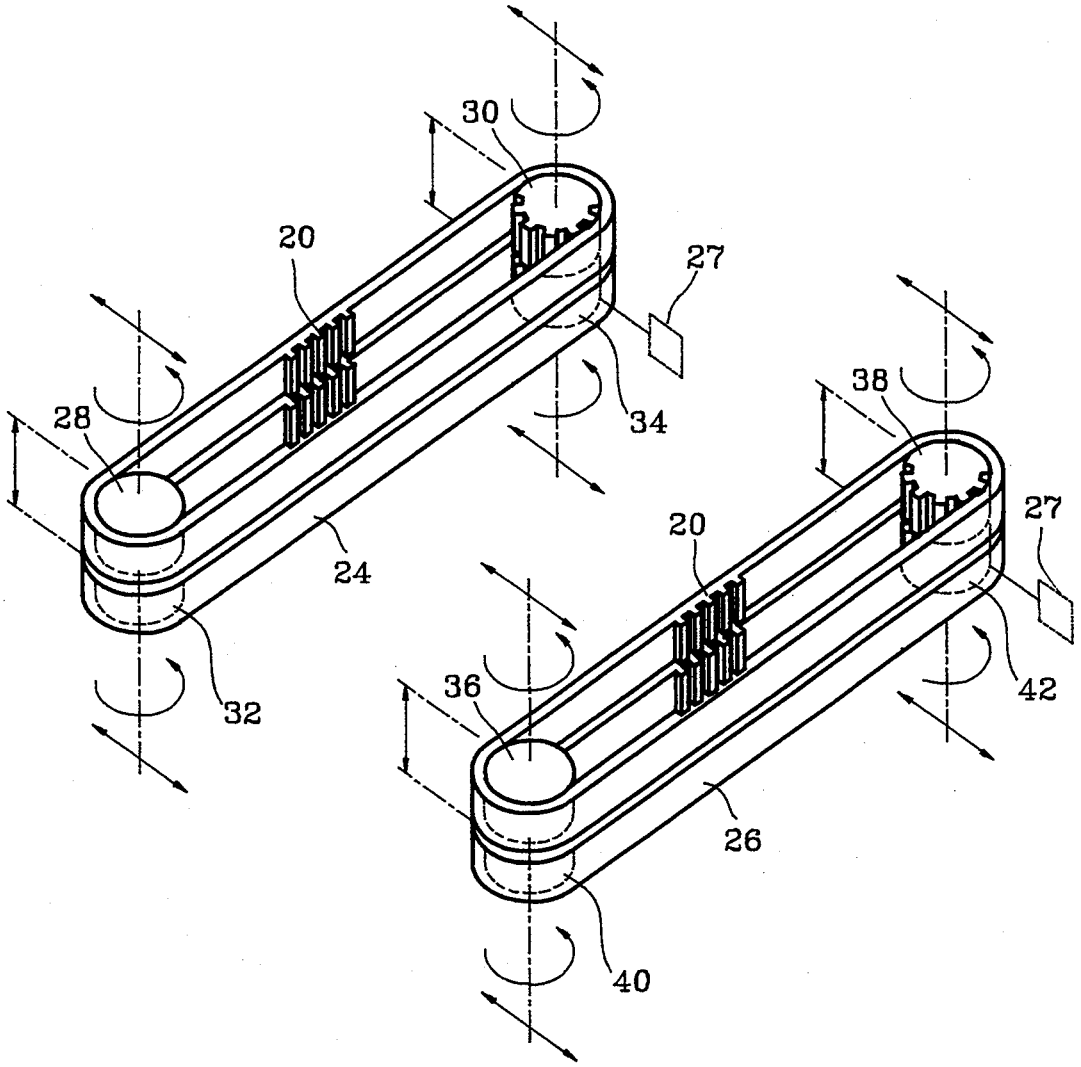
FIG. 7 is a perspective view from above of the positioning device shown in FIG. 5.

From FIGS. 3 to 7 it can be seen that the positioning device 10 comprises first means including upper and lower pairs of endless belts 20, 22 and 24, 26 respectively. Preferably the belts are each formed with a tooth design on their inside surface (FIG. 7) and are flexible. The belts of each pair are horizontally spaced apart with the left hand belts as seen best in FIG. 7 rotating in an anticlockwise direction and the right hand belts rotating in a clockwise direction. Each belt is driven by its own pair of pulleys 28 to 42. The pulleys are movable in unison vertically by any conventional actuating means, indicated at 43, to move the endless belts 20 to 26 between said upper, rest or retracted position and said lower, working or operative position in which the belts of each pair lie alongside the associated pair of arms 16, 18 of the arm assembly 12 of the line closing machine. Each pulley is also independently movable in a horizontal direction laterally of the belt axis towards and away from the associated arm of the arm assembly 12, again by conventional actuating means, indicated at 27. Preferably the pulleys each have teeth on their periphery to match the belt teeth if provided (FIG. 7).

Figure 4:
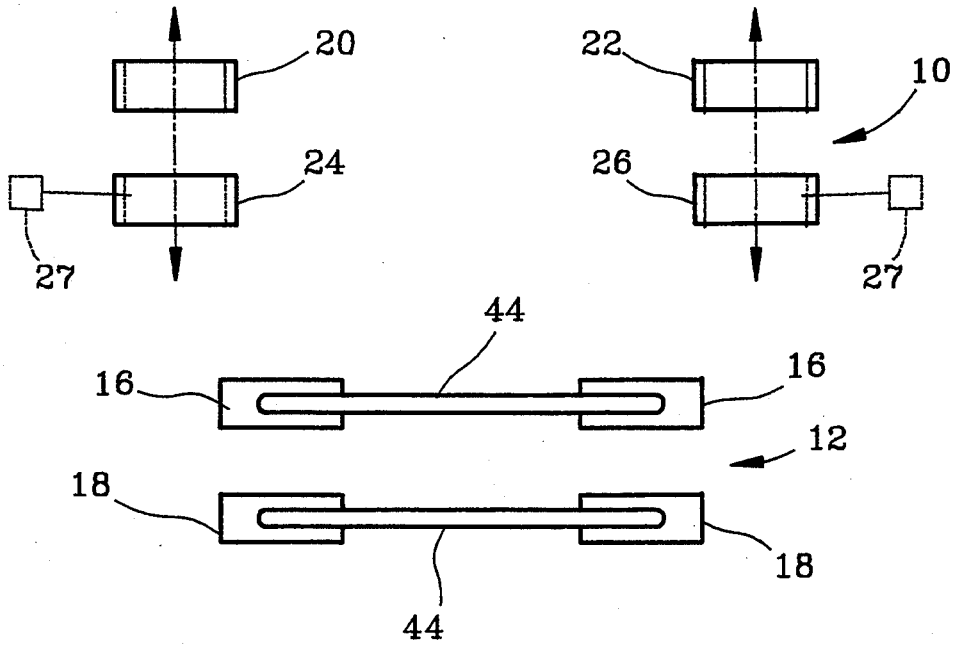
FIG. 4 is a diagrammatic view in the direction of arrow A of FIG. 3 showing the positioning device in relation to the arm assembly of FIG. 3.

FIG. 4 shows the rest position of the positioning device at the loading station A where the pulleys and belts are above the arms 16, 18 of the Takatori line closer. There is all round clearance between the positioning device and the arms 16, 18 in this position. However, they are moving angularly in concert in a clockwise direction from the loading station A to a scissoring station approximately 60° around the line closer machine.

After the stockings 14 have been loaded onto the arms 16, 18 assisted by a TEFLON (Registered Trade Mark) guide piece 44, the positioning device 10 is lowered from its rest or retracted position (FIG. 4) into its operative position as shown in FIGS. 5 and 6 in which each endless belt 20 to 26 lies horizontally adjacent an associated arm of the arm assembly 12, this lowering occurring at a synchonized and suitable position in the angular movement of the line closer.

The belts are always rotating when in their operative position and rotating as previously described, and they are then moved inwardly to contact the fabric of the stockings 14 on the arms 16, 18 of the arm assembly 12. A force may be applied, by any conventional actuating means shown at 27A, to the inside face of each belt, for example, midway between the associated pulleys at point "X", to bring the belt into contact with the adjacent stocking at that point. Because each of the pulleys is also horizontally movable independently of the others it is possible to bring the whole of one side of each endless belt into contact with the adjacent stocking, or either the front half or rear half of the belt. FIG. 10 shows various possible configurations of each endless belt in contact with an adjacent stocking 14 on the arm assembly 12.

Figure 8:
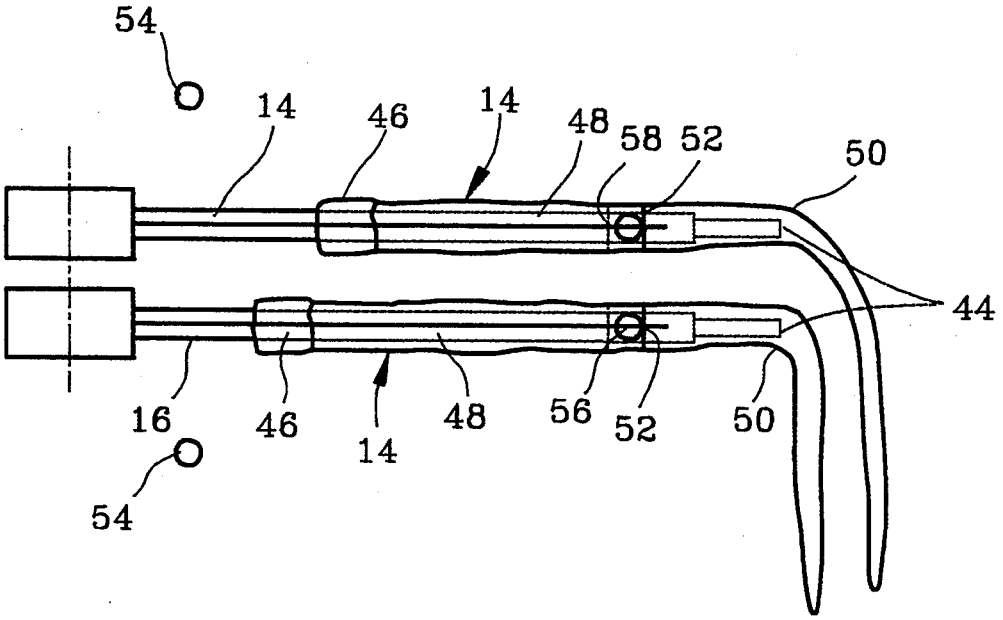
FIG. 8 is a side elevation of the arm assembly of FIGS. 4 to 6, showing a stocking loaded on each pair of arms.
Figure 9:
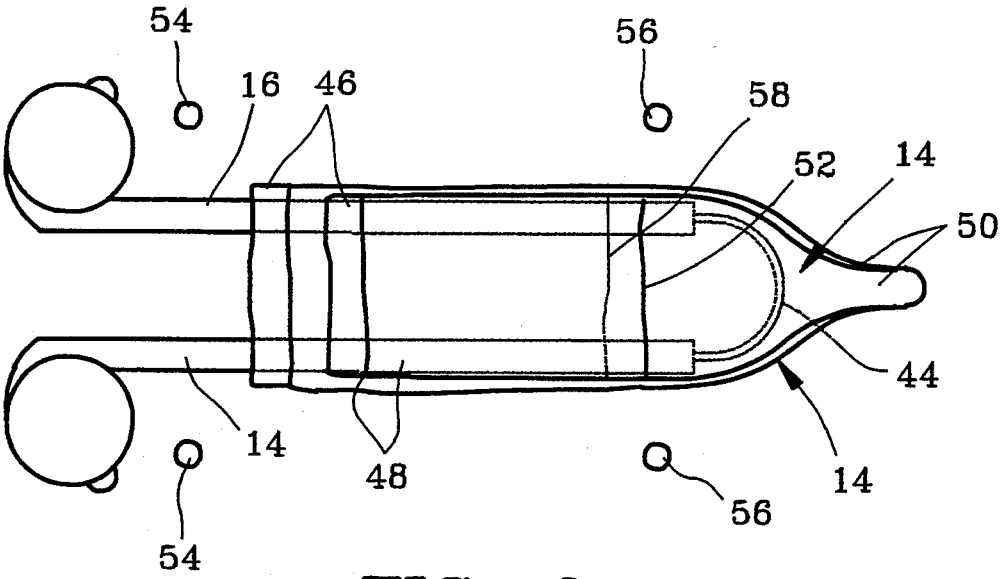
FIG. 9 is a plan view of the arm assembly of FIG. 8.
Figure 10A:
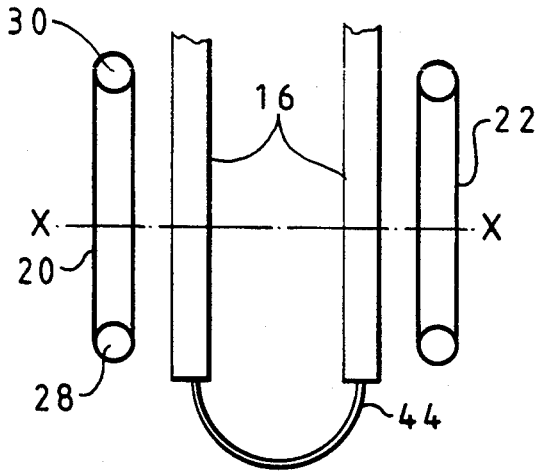
Figure 10B:
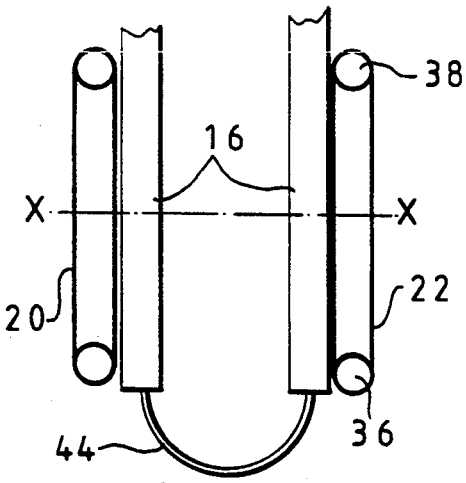
Figure 10C:
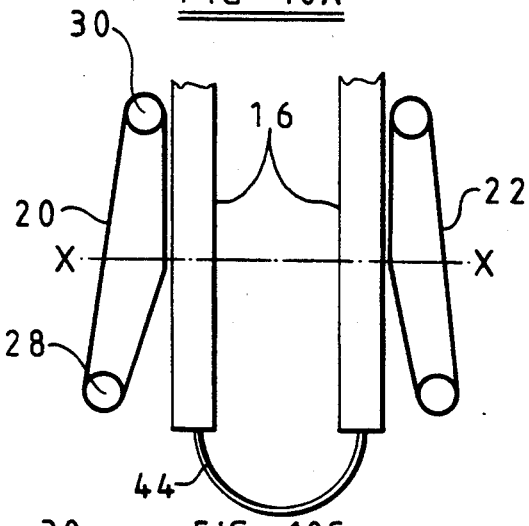
Figure 10D:
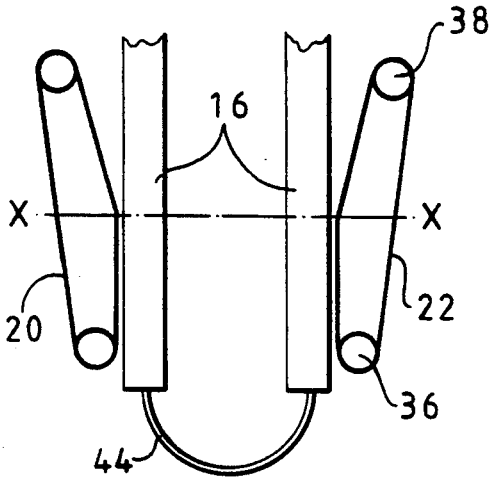
Figure 10E:
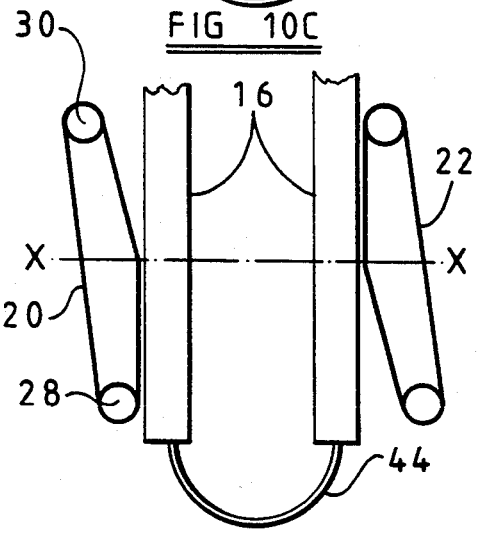
Figure 10F:
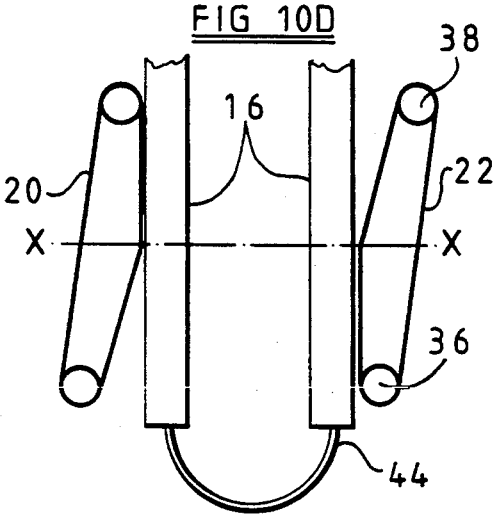
Figure 10G:
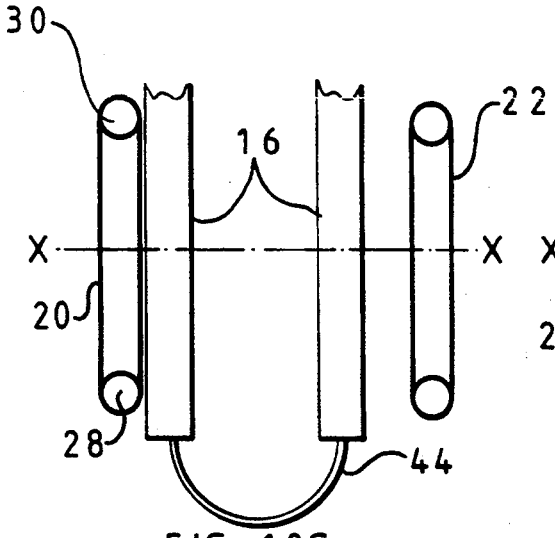
Figure 10H:
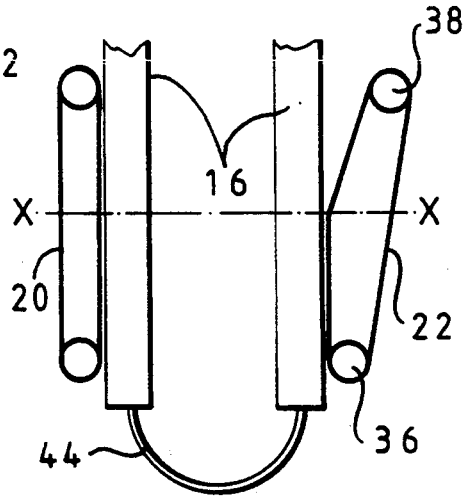
Figure 10I:
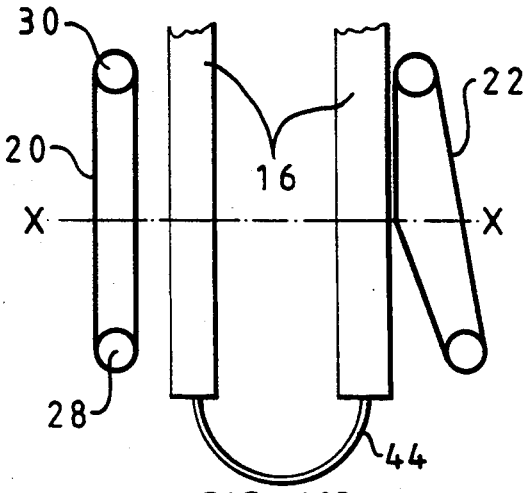
Figure 10J:
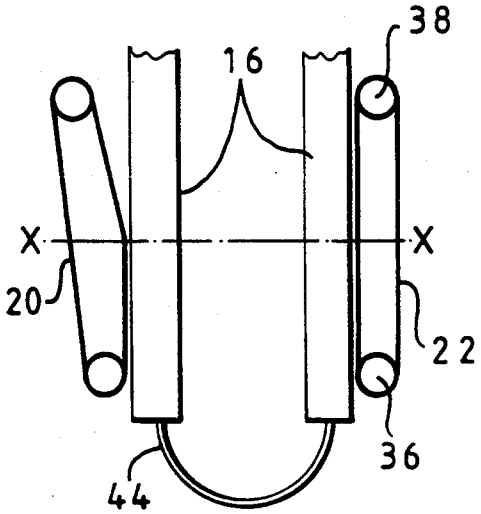
Figure 10K:
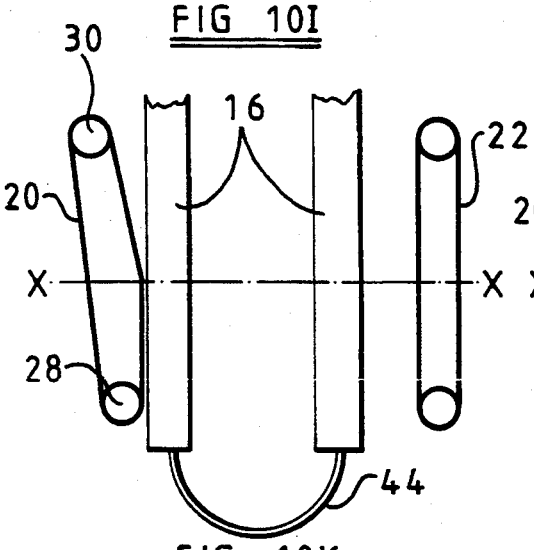
Figure 10L:
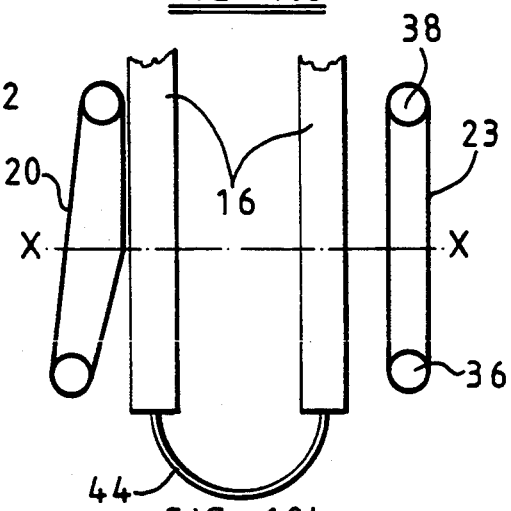

FIGS. 8 and 9 show two stockings 14 loaded on respective upper and lower pairs of arms 16, 18 of the line closer. Each stocking has a waistband end 46, usually of an elastic type knitted construction, a body portion 48, a leg portion 50 and a body/leg interface 52.

The adhesion obtained between each moving belt and the associated stocking 14 results in the stocking being moved along the arm assembly and the possible variations in the contact of each belt with the stocking enables movement of the stocking fabric to be controlled either at its waistband end 46 or the body/leg interface 52 or along a portion of the stocking extending from either of these positions towards the other or along the whole of the stocking portion between these two points. Suitable pairs of sensors or detectors 54, 56 are both provided, at respective opposite sides of the arms 14, 16 (FIGS. 8 and 9), to enable accurate positioning of each stocking on the arm assembly 12. When, for example, the sensor 54 indicates that the waistband 46 of a stocking has reached that point, the pulleys 30, 34 or 38, 42 can then be moved horizontally away from the stocking to remove contact of the belt with the stocking at that point. However, contact between each belt and the stocking at point "X" and the pulleys 28, 36, or 32, 40 is still maintained until the sensor 56 at the body/leg interface 52 indicates that the remainder of the stocking body portion has been accurately positioned.

To assist in positioning of the body portion by the sensor 56, a stripe of indicator thread or yarn, 58, usually coloured e.g. red or blue, is provided in each of the stockings at a suitable position. This indicator yarn may conveniently be composed of an alginate compound which dissolves in water during subsequent processing stages of the panti-hose. The indicator yarn may include either a metallic oxide constituent and/or phosphorescent agent which may be introduced during manufacture of the yarn or added after manufacture as a coating. This would enable the yarn to be detected magnetically and/or optically, as well as or instead of visually.

Once the stockings have been accurately positioned and the first cycle of the line closer completed, the positioning device 10 is then raised vertically into its retracted position shown in FIG. 4 so as not to foul the still rotating assembly 12. Operation of the positioning device may be effected in concert with the arm assembly 12 during movement of the arm assembly 12 from its loading station, typically through an angle of 60° to a scissoring station. Once the positioning device has been withdrawn into its retracted position it is then moved in an anti-clockwise direction into its start position for operation with the next successive arm assembly at the loading station, whilst the arm assembly with the accurately positioned stockings thereon continues to move clockwise around the line closer.

From the description, it will be appreciated that precision loading of the stockings is not necessary, since the adhesion obtained between the belts and the fabric pressed against the arms moves the fabric up the arms until the required position of each stocking on its arm is reached.

I claim:

1. A device for positioning a pair of stockings on a machine of the type having a number of arm assemblies each of which consists of upper and lower pairs of support arms, the upper pair supporting, in use, a first stocking and the lower pair supporting, in use, a second stocking, the two stockings being cut and seamed together, during operation of the machine, to form a pair of paint-hose, characterized in that the device comprises:

respective first means for engaging opposite sides of each stocking loaded onto an arm assembly of said machine, said first means being movable between a first, retracted position away from said stockings, and a second, operative position adjacent said stockings;

means for moving said first means into engagement with said stockings to effect adjustment of the position of said stockings oil said arm assembly;

and wherein the first means comprise an upper pair and a lower pair of belts each being capable of linear movement when contacting a stocking to effect said adjustment;

said first means comprising upper and lower pairs of endless belts, each drivable by its own pair of pulleys, the upper and lower belts at one side of the stockings rotating in the opposite direction to the upper and lower belts at the other side of the stockings; and each pulley being itself independently movable to move its associated belt into engagement with and out of engagement from a stocking in said second position of said first means.

2. A device according to claim 1, characterized in that the pulleys, with their associated belts, are movable in unison from a position above the arm assembly having said first and second stockings loaded thereon, in use, corresponding to said retracted position of said first means, to a position where the belts of each pair lie alongside the associated pair of arms of said arm assembly having said first and second stockings loaded thereon, in use, corresponding to said operative position of said first means.

3. A device according to any one of claims 1 or 2, characterized in that the upper and lower pairs of endless kits are always rotating when said first means is in said operative position.

4. A device according to any one of claims 2 or 3, characterized in that force can be applied to each of the belts midway between its pulleys to move it into engagement with a stocking.

5. A device according to claim 1, further comprising sensing means to detect when at least part of a stocking has been moved along a pair of support arms to its required adjusted position, the sensing means being operable to effect disengagement of the first means from at least part of the stocking.

6. A device according to any one of claims 2 to 4, characterized in that respective sensors are provided at opposite sides of the arm assembly having said first and second stockings loaded thereon, in use, to detect correct positioning of the stockings on the arms of the arm assembly and to disengage at least one pair of upper or lower belts from at or adjacent at least the correctly positioned part of at least one of the stockings.

7. A device according to claim 6, wherein the sensors are operable to detect correct positioning of a waistband of one or both stockings.

8. A device according to claim 6, wherein the sensors are operable to detect correct positioning of a body/leg interface of one or both stockings.

9. A device according to claim 7, wherein, in use, the sensing means is operable to detect said required adjusted position by means of an indicator yarn in the stocking.

10. A device according to claim 9, wherein said indicator yarn is detected magnetically.

11. A device according to claim 11, wherein said indicator yarn is detected optically.

* * * * *